US010533571B2

(12) United States Patent
Rende, Jr.

(10) Patent No.: US 10,533,571 B2
(45) Date of Patent: Jan. 14, 2020

(54) PUMP SYSTEMS WITH VARIABLE DIAMETER IMPELLER DEVICES

(71) Applicant: Carmine Rende, Jr., Sanibel, FL (US)

(72) Inventor: Carmine Rende, Jr., Sanibel, FL (US)

(73) Assignees: Carolyn Rende Fortin, Winnetka, IL (US); Steven Rende, Lewisville, TX (US)

( * ) Notice: Subject to any disclaimer, the term of this patent is extended or adjusted under 35 U.S.C. 154(b) by 0 days.

(21) Appl. No.: 15/876,134

(22) Filed: Jan. 20, 2018

(65) Prior Publication Data

US 2019/0226490 A1 Jul. 25, 2019

(51) Int. Cl.

| | |
|---|---|
| ***F04D 29/24*** | (2006.01) |
| ***F04D 29/18*** | (2006.01) |
| ***F04D 29/22*** | (2006.01) |
| ***F04D 15/00*** | (2006.01) |
| ***F04D 29/32*** | (2006.01) |
| ***F04D 29/36*** | (2006.01) |
| ***F04D 29/28*** | (2006.01) |
| ***F04D 29/30*** | (2006.01) |
| ***F04D 29/42*** | (2006.01) |

(52) U.S. Cl.

CPC ..... *F04D 29/247* (2013.01); *F04D 15/0038* (2013.01); *F04D 15/0055* (2013.01); *F04D 29/181* (2013.01); *F04D 29/2205* (2013.01); *F04D 29/2266* (2013.01); *F04D 29/287* (2013.01); *F04D 29/305* (2013.01); *F04D 29/323* (2013.01); *F04D 29/364* (2013.01); *F04D 29/42* (2013.01)

(58) Field of Classification Search

CPC ..... F04D 29/247; F04D 15/0038; F04D 15/0055; F04D 27/002; F04D 29/30; F04D 29/362; F04D 29/364; F04D 29/2266; F04D 29/287; F04D 29/323

USPC ..... 415/30, 33, 36, 42, 106, 140, 141, 415/129–130; 416/44, 50, 51, 52, 53, 416/87–89

See application file for complete search history.

(56) References Cited

U.S. PATENT DOCUMENTS 791,596 A * 6/1905 Waxel ..... F04D 29/247 415/141
1,130,616 A * 3/1915 Lorenz ..... F04D 29/2266 415/106
2,694,981 A * 11/1954 Daugherty ..... F04D 29/126 277/348
3,073,248 A * 1/1963 Bartels ..... F04D 29/042 415/131

(Continued)

*Primary Examiner* — Christopher Verdier
(74) *Attorney, Agent, or Firm* — Ariel S. Bentolila; Bay Area IP Group, LLC

(57) ABSTRACT

A system having a variable diameter impeller device that is operable for reducing an energy consumption of a rotating fluid or gas pump by increasing the impeller diameter as a speed of the rotating fluid or gas pump increases and decreasing the impeller diameter as the speed decreases. An extendable vane arrangement is configured to move along an elongated curved or sloping slot, the movement along the elongated curved or sloping slot is operable for increasing and decreasing a diameter of the impeller device. A spring arrangement having a first end and a second end extends and retracts to dynamically increase or decrease a diameter of the impeller device.

17 Claims, 13 Drawing Sheets

(56) References Cited

U.S. PATENT DOCUMENTS

| | | | | |
|---|---|---|---|---|
| 3,212,547 | A * | 10/1965 | McKay | F16B 39/284<br>411/306 |
| 3,901,623 | A * | 8/1975 | Grennan | F04D 15/0055<br>415/141 |
| 4,485,888 | A * | 12/1984 | Yu | F01P 5/06<br>123/41.49 |
| 6,220,819 | B1 | 4/2001 | Chien et al. | |
| 6,547,519 | B2 * | 4/2003 | deBlanc | F04D 29/282<br>415/141 |
| 6,935,839 | B2 * | 8/2005 | Pascoe | F04D 15/0055<br>415/206 |
| 2004/0033158 | A1 * | 2/2004 | Chiba | C22C 19/055<br>420/585 |
| 2011/0255970 | A1 | 10/2011 | Fei et al. | |
| 2011/0318202 | A1 * | 12/2011 | Care | F04D 25/088<br>417/410.1 |
| 2013/0336811 | A1 | 12/2013 | Muller et al. | |

* cited by examiner

PUMP SYSTEMS WITH VARIABLE DIAMETER IMPELLER DEVICES

CROSS-REFERENCE TO RELATED APPLICATIONS

Not applicable

RELATED CO-PENDING U.S. PATENT APPLICATIONS

Not applicable

INCORPORATION BY REFERENCE OF SEQUENCE LISTING PROVIDED AS A TEXT FILE

Not applicable

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection by the author thereof. The copyright owner has no objection to the facsimile reproduction by anyone of the patent document or patent disclosure for the purposes of referencing as patent prior art, as it appears in the Patent and Trademark Office, patent file or records, but otherwise reserves all copyright rights whatsoever.

BACKGROUND OF THE RELEVANT PRIOR ART

One or more embodiments of the invention generally relate to pumps. More particularly, certain embodiments of the invention relate to liquid or gas moving systems with variable diameter impeller.

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

It is believed that electrical power costs for centrifugal water or air pumps may account for a large portion of the operating costs for the most common mechanical equipment used throughout the world's buildings. Centrifugal pumps are common equipment in many industries because they are typically simple, effective, and inexpensive. Impellers are the rotating part of a centrifugal pump to move a fluid by rotation. The rotating part may also be turned by the flow of the fluid. Centrifugal water or air pumps may often be strongly influenced by the impeller. For example, without limitation, varying the impeller diameter of a centrifugal water or air pump may act as a factor in reducing energy usage where loads constantly fluctuate.

Current centrifugal water or air pump designs typically use fixed diameter impellers with variable speed electric drives and motors to vary equipment speeds based on actual load conditions. Fluid moving devices with impellers that have a fixed diameter typically involve relationships between flow, speed, resistance, power and diameter based on pump affinity laws that are derived from the basic principles of fluid mechanics that use the method of dynamic similitude. This essentially means that the forces acting on the fluid, such as, but not limited to, inertia and viscous or friction forces, remain in the same proportions as operating conditions change. One pump affinity law in which an impeller diameter is held constant states that $$F1/F2=S1/S2,$$

$$R1/R2=S1/S2^2, \text{ and}$$

$$P1/P2=S1/S2^3,$$

where F equals flow, S equals speed, R equals resistance, P equals power, and D equals diameter. If an impeller may vary its diameter as speed is increased or decreased, the power formula above can be revised by adding the relationship between varying impeller diameters to the fifth power, and this pump law becomes $$P1/P2=S1/S2^3 \times D1/D2^5.$$

Pump selections for heating and cooling systems for larger commercial sector buildings are usually selected for maximum design flow conditions and are often oversized for their service. Maximum design flow typically does not occur very often. The majority of pumps in most buildings employ variable flow water systems that operate between 65% and 70% of their maximum flow condition most of the time and are equipped with a variable speed drive for energy conservation. Since it is normally not possible to accurately calculate piping system resistances completely due to workmanship in installation, piping roughness affected by manufacturing, and other factors, pumps are usually selected with operating points in a region of the pump manufacturer's curve where the efficiency is held fairly constant. Otherwise, dynamic similitude in flows may not be achieved, and the predicted values will most likely be incorrect when using the pump affinity laws.

In many applications, the effect of reducing the impeller diameter of a water or air pump is, for practical purposes, substantially similar to that of a reduction in pump speed. As impeller diameter is reduced simultaneously with pump speed, a centrifugal water pump typically operates more efficiently and may require less electrical power. It is believed that it may be uneconomical to operate a pump at a speed far below its normal rated speed since pumps are often oversized for their service. Conversely, running a pump at a higher speed may exceed the pump horsepower capability of the pump. In practice it is typically appropriate to select a pump as close to its maximum impeller size as practical. In many cases the maximum sized pump impeller may be trimmed to suit the design conditions. One may expect that trimming a pump impeller more than 10% might cause flow slip between the impeller housing case or shroud and the pump casing, and a large loss of pump impeller diameter may lead to a violation of the pump affinity laws that are based on dynamic similitude.

By way of educational background, an aspect of the related technology generally useful to be aware of is that a currently available water pump impeller with variable impeller vanes may be cited as a constitution in which movement amounts of the respective vanes move in accordance with water pressure force. The pump impeller design in this approach utilizes a single torsion spring and plate cams to bias impeller rotation and a balance structure for stability. In typical use of such pumps, as engine speed increases, pump impeller speed and water pressure also increase. When this happens, the elastic force of the single torsion spring may move all of the vanes of the impeller inward by a plate cam to reduce the impeller diameter to typically decrease flow. At low engine speeds, the torsion spring may move all of the vane bodies outward to enlarge the impeller diameter to typically increase flow. This approach may be used to operate a vehicle water pump as an electric water pump where all vehicle cooling circuits are no longer tied to the rotation speed of an engine but controlled by a vehicle's single-action outlet water temperature. The variable diameter water pump impeller may vary flow as required by the temperature of the cooling circuit while the pump electric driver can be of the constant speed or variable speed type depending on the size and type of engine.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1A is a cross sectional view of the enclosed impeller with the extendable vanes fully retracted. FIG. 1B is a cross sectional view of the enclosed impeller with the extendable vanes fully extended. FIG. 1C is a diagrammatic front view of the impeller with the extendable impeller vanes in a fully retracted position. FIG. 1D is a diagrammatic front view of the impeller with the extendable impeller vanes in a fully extended position, and FIG. 1E is a diagrammatic rear view of the enclosed impeller;

FIG. 2A is a perspective bottom view of the extendable vane, and FIG. 2B is a perspective top view of the extendable vane;

FIG. 3A is a diagrammatic side view of engagement means for engaging an extendable vane within a slot in the housing, and FIG. 3B is a diagrammatic side view of engagement means for connecting an end of a torsion spring to the housing.

Figure 1A:
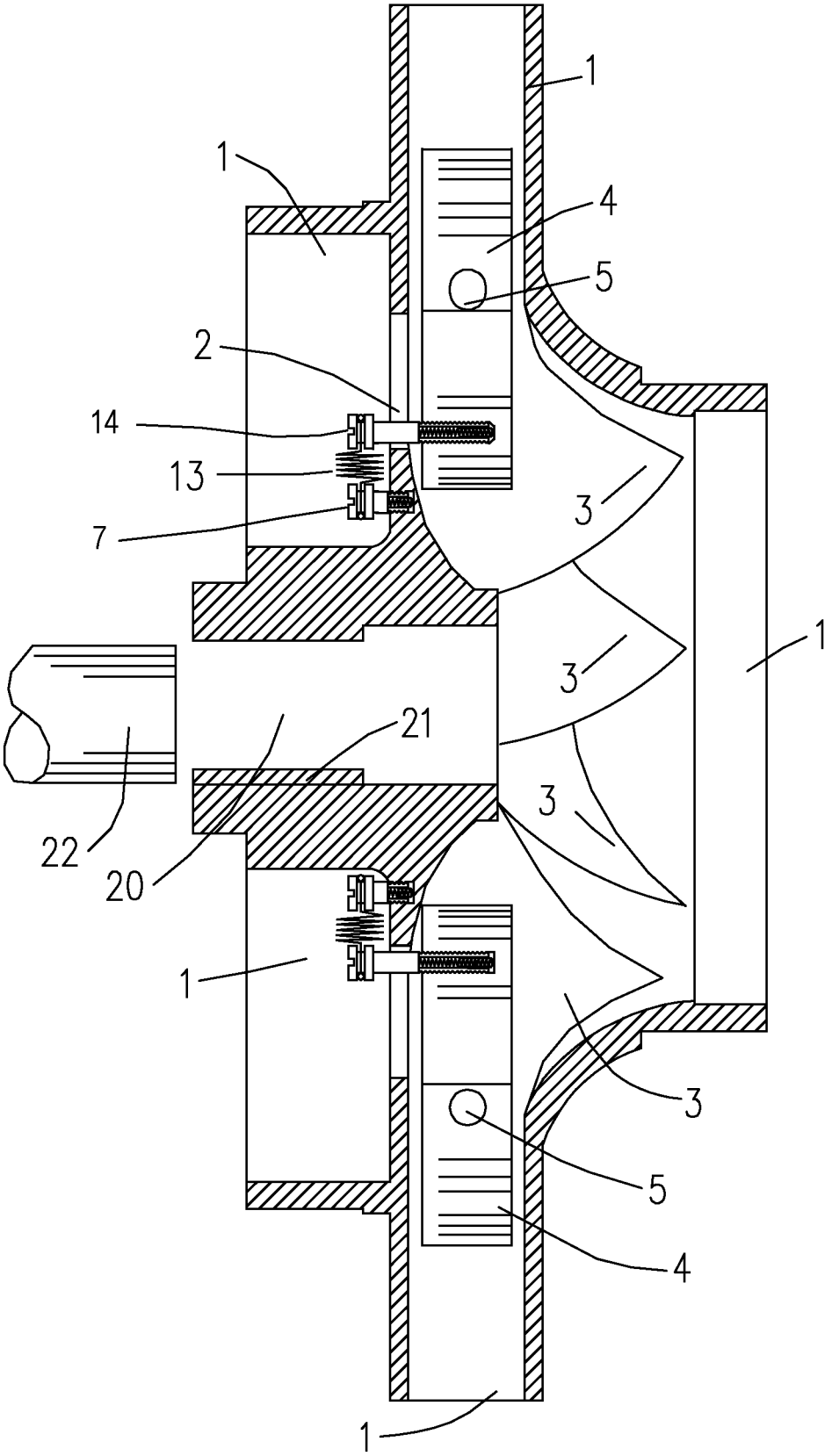
FIG. 1A, FIG. 1B, FIG. 1C, FIG. 1D, and FIG. 1E illustrate an exemplary enclosed impeller for fluid or gas moving systems comprising fixed vanes and extendable vanes, in accordance with an embodiment of the present invention.

Unless otherwise indicated illustrations in the figures are not necessarily drawn to scale.

DETAILED DESCRIPTION OF SOME EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

All words of approximation as used in the present disclosure and claims should be construed to mean "approximate," rather than "perfect," and may accordingly be employed as a meaningful modifier to any other word, specified parameter, quantity, quality, or concept. Words of approximation, include, yet are not limited to terms such as "substantial", "nearly", "almost", "about", "generally", "largely", "essentially", "closely approximate", etc.

As will be established in some detail below, it is well settle law, as early as 1939, that words of approximation are not indefinite in the claims even when such limits are not defined or specified in the specification.

For example, see Ex parte Mallory, 52 USPQ 297, 297 (Pat. Off. Bd. App. 1941) where the court said "The examiner has held that most of the claims are inaccurate because apparently the laminar film will not be entirely eliminated. The claims specify that the film is "substantially" eliminated and for the intended purpose, it is believed that the slight portion of the film which may remain is negligible. We are of the view, therefore, that the claims may be regarded as sufficiently accurate."

Note that claims need only "reasonably apprise those skilled in the art" as to their scope to satisfy the definiteness requirement. See Energy Absorption Sys., Inc. v. Roadway Safety Servs., Inc., Civ. App. 96-1264, slip op. at 10 (Fed. Cir. Jul. 3, 1997) (unpublished) Hybridtech v. Monoclonal Antibodies, Inc., 802 F.2d 1367, 1385, 231 USPQ 81, 94 (Fed. Cir. 1986), cert. denied, 480 U.S. 947 (1987). In addition, the use of modifiers in the claim, like "generally" and "substantial," does not by itself render the claims indefinite. See Seattle Box Co. v. Industrial Crating & Packing, Inc., 731 F.2d 818, 828-29, 221 USPQ 568, 575-76 (Fed. Cir. 1984).

Moreover, the ordinary and customary meaning of terms like "substantially" includes "reasonably close to: nearly, almost, about", connoting a term of approximation. See In re Frye, Appeal No. 2009-006013, 94 USPQ2d 1072, 1077, 2010 WL 889747 (B.P.A.I. 2010) Depending on its usage, the word "substantially" can denote either language of approximation or language of magnitude. Deering Precision Instruments, L.L.C. v. Vector Distribution Sys., Inc., 347 F.3d 1314, 1323 (Fed. Cir. 2003) (recognizing the "dual ordinary meaning of th[e] term ["substantially"] as connoting a term of approximation or a term of magnitude"). Here, when referring to the "substantially halfway" limitation, the Specification uses the word "approximately" as a substitute for the word "substantially" (Fact 4). (Fact 4). The ordinary meaning of "substantially halfway" is thus reasonably close to or nearly at the midpoint between the forwardmost point of the upper or outsole and the rearwardmost point of the upper or outsole.

Similarly, the term 'substantially' is well recognized in case law to have the dual ordinary meaning of connoting a term of approximation or a term of magnitude. See Dana Corp. v. American Axle & Manufacturing, Inc., Civ. App. 04-1116, 2004 U.S. App. LEXIS 18265, *13-14 (Fed. Cir. Aug. 27, 2004) (unpublished). The term "substantially" is commonly used by claim drafters to indicate approximation. See Cordis Corp. v. Medtronic AVE Inc., 339 F.3d 1352, 1360 (Fed. Cir. 2003) ("The patents do not set out any numerical standard by which to determine whether the thickness of the wall surface is 'substantially uniform.' The term 'substantially,' as used in this context, denotes approximation. Thus, the walls must be of largely or approximately uniform thickness."); see also Deering Precision Instruments, LLC v. Vector Distribution Sys., Inc., 347 F.3d 1314, 1322 (Fed. Cir. 2003); Epcon Gas Sys., Inc. v. Bauer Compressors, Inc., 279 F.3d 1022, 1031 (Fed. Cir. 2002). We find that the term "substantially" was used in just such a manner in the claims of the patents-in-suit: "substantially uniform wall thickness" denotes a wall thickness with approximate uniformity.

It should also be noted that such words of approximation as contemplated in the foregoing clearly limits the scope of claims such as saying 'generally parallel' such that the adverb 'generally' introduces some amount of deviation from perfection to the meaning of parallel. Accordingly, it is well settled that such words of approximation as contemplated in the foregoing (e.g., like the phrase 'generally parallel') envisions some amount of deviation from perfection (e.g., not exactly parallel), and that such words of approximation as contemplated in the foregoing are descriptive terms commonly used in patent claims to avoid a strict numerical boundary to the specified parameter. To the extent that the plain language of the claims relying on such words of approximation as contemplated in the foregoing are clear and uncontradicted by anything in the written description herein or the figures thereof, it is improper to rely upon the present written description, the figures, or the prosecution history to add limitations to any of the claim of the present invention with respect to such words of approximation as contemplated in the foregoing. That is, under such circumstances, relying on the written description and prosecution history to reject the ordinary and customary meanings of the words themselves is impermissible. See, for example, Liquid Dynamics Corp. v. Vaughan Co., 355 F.3d 1361, 69 USPQ2d 1595, 1600-01 (Fed. Cir. 2004). The plain language of phrase 2 requires a "substantial helical flow." The term "substantial" is a meaningful modifier implying "approximate," rather than "perfect." In Cordis Corp. v. Medtronic AVE, Inc., 339 F.3d 1352, 1361 (Fed. Cir. 2003), the district court imposed a precise numeric constraint on the term "substantially uniform thickness." We noted that the proper interpretation of this term was "of largely or approximately uniform thickness" unless something in the prosecution history imposed the "clear and unmistakable disclaimer" needed for narrowing beyond this simple-language interpretation. Id. In Anchor Wall Systems v. Rockwood Retaining Walls, Inc., 340 F.3d 1298, 1311 (Fed. Cir. 2003)" Id. at 1311. Similarly, the plain language of claim 1 requires neither a perfectly helical flow nor a flow that returns precisely to the center after one rotation (a limitation that arises only as a logical consequence of requiring a perfectly helical flow).

The reader should appreciate that case law generally recognizes a dual ordinary meaning of such words of approximation, as contemplated in the foregoing, as connoting a term of approximation or a term of magnitude; e.g., see Deering Precision Instruments, L.L.C. v. Vector Distrib. Sys., Inc., 347 F.3d 1314, 68 USPQ2d 1716, 1721 (Fed. Cir. 2003), cert. denied, 124 S. Ct. 1426 (2004) where the court was asked to construe the meaning of the term "substantially" in a patent claim. Also see Epcon, 279 F.3d at 1031 ("The phrase 'substantially constant' denotes language of approximation, while the phrase 'substantially below' signifies language of magnitude, i.e., not insubstantial."). Also, see, e.g., Epcon Gas Sys., Inc. v. Bauer Compressors, Inc., 279 F.3d 1022 (Fed. Cir. 2002) (construing the terms "substantially constant" and "substantially below"); Zodiac Pool Care, Inc. v. Hoffinger Indus., Inc., 206 F.3d 1408 (Fed. Cir. 2000) (construing the term "substantially inward"); York Prods., Inc. v. Cent. Tractor Farm & Family Ctr., 99 F.3d 1568 (Fed. Cir. 1996) (construing the term "substantially the entire height thereof"); Tex. Instruments Inc. v. Cypress Semiconductor Corp., 90 F.3d 1558 (Fed. Cir. 1996) (construing the term "substantially in the common plane"). In conducting their analysis, the court instructed to begin with the ordinary meaning of the claim terms to one of ordinary skill in the art. Prima Tek, 318 F.3d at 1148. Reference to dictionaries and our cases indicates that the term "substantially" has numerous ordinary meanings. As the district court stated, "substantially" can mean "significantly" or "considerably." The term "substantially" can also mean "largely" or "essentially." Webster's New 20th Century Dictionary 1817 (1983).

Words of approximation, as contemplated in the foregoing, may also be used in phrases establishing approximate ranges or limits, where the end points are inclusive and approximate, not perfect; e.g., see AK Steel Corp. v. Sollac, 344 F.3d 1234, 68 USPQ2d 1280, 1285 (Fed. Cir. 2003) where it where the court said [W]e conclude that the ordinary meaning of the phrase "up to about 10%" includes the "about 10%" endpoint. As pointed out by AK Steel, when an object of the preposition "up to" is nonnumeric, the most natural meaning is to exclude the object (e.g., painting the wall up to the door). On the other hand, as pointed out by Sollac, when the object is a numerical limit, the normal meaning is to include that upper numerical limit (e.g., counting up to ten, seating capacity for up to seven passengers). Because we have here a numerical limit—"about 10%"—the ordinary meaning is that that endpoint is included.

In the present specification and claims, a goal of employment of such words of approximation, as contemplated in the foregoing, is to avoid a strict numerical boundary to the modified specified parameter, as sanctioned by Pall Corp. v. Micron Separations, Inc., 66 F.3d 1211, 1217, 36 USPQ2d 1225, 1229 (Fed. Cir. 1995) where it states "It is well established that when the term "substantially" serves reasonably to describe the subject matter so that its scope would be understood by persons in the field of the invention, and to distinguish the claimed subject matter from the prior art, it is not indefinite." Likewise see Verve LLC v. Crane Cams Inc., 311 F.3d 1116, 65 USPQ2d 1051, 1054 (Fed. Cir. 2002). Expressions such as "substantially" are used in patent documents when warranted by the nature of the invention, in order to accommodate the minor variations that may be appropriate to secure the invention. Such usage may well satisfy the charge to "particularly point out and distinctly claim" the invention, 35 U.S.C. § 112, and indeed may be necessary in order to provide the inventor with the benefit of his invention. In Andrew Corp. v. Gabriel Elecs. Inc., 847 F.2d 819, 821-22, 6 USPQ2d 2010, 2013 (Fed. Cir. 1988) the court explained that usages such as "substantially equal" and "closely approximate" may serve to describe the invention with precision appropriate to the technology and without intruding on the prior art. The court again explained in Ecolab Inc. v. Envirochem, Inc., 264 F.3d 1358, 1367, 60 USPQ2d 1173, 1179 (Fed. Cir. 2001) that "like the term 'about,' the term 'substantially' is a descriptive term commonly used in patent claims to avoid a strict numerical boundary to the specified parameter," see Ecolab Inc. v. Envirochem Inc., 264 F.3d 1358, 60 USPQ2d 1173, 1179 (Fed. Cir. 2001) where the court found that the use of the term "substantially" to modify the term "uniform" does not render this phrase so unclear such that there is no means by which to ascertain the claim scope.

Similarly, other courts have noted that like the term "about," the term "substantially" is a descriptive term commonly used in patent claims to "avoid a strict numerical boundary to the specified parameter."; e.g., see Pall Corp. v. Micron Seps., 66 F.3d 1211, 1217, 36 USPQ2d 1225, 1229 (Fed. Cir. 1995); see, e.g., Andrew Corp. v. Gabriel Elecs. Inc., 847 F.2d 819, 821-22, 6 USPQ2d 2010, 2013 (Fed. Cir. 1988) (noting that terms such as "approach each other," "close to," "substantially equal," and "closely approximate" are ubiquitously used in patent claims and that such usages, when serving reasonably to describe the claimed subject matter to those of skill in the field of the invention, and to distinguish the claimed subject matter from the prior art, have been accepted in patent examination and upheld by the courts). In this case, "substantially" avoids the strict 100% nonuniformity boundary.

Indeed, the foregoing sanctioning of such words of approximation, as contemplated in the foregoing, has been established as early as 1939, see Ex parte Mallory, 52 USPQ 297, 297 (Pat. Off. Bd. App. 1941) where, for example, the court said "the claims specify that the film is "substantially" eliminated and for the intended purpose, it is believed that the slight portion of the film which may remain is negligible. We are of the view, therefore, that the claims may be regarded as sufficiently accurate." Similarly, In re Hutchison, 104 F.2d 829, 42 USPQ 90, 93 (C.C.P.A. 1939) the court said "It is realized that "substantial distance" is a relative and somewhat indefinite term, or phrase, but terms and phrases of this character are not uncommon in patents in cases where, according to the art involved, the meaning can be determined with reasonable clearness."

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will be described in detail below with reference to embodiments thereof as illustrated in the accompanying drawings.

References to a "device," an "apparatus," a "system," etc., in the preamble of a claim should be construed broadly to mean "any structure meeting the claim terms" exempt for any specific structure(s)/type(s) that has/(have) been explicitly disavowed or excluded or admitted/implied as prior art in the present specification or incapable of enabling an object/aspect/goal of the invention. Furthermore, where the present specification discloses an object, aspect, function, goal, result, or advantage of the invention that a specific prior art structure and/or method step is similarly capable of performing yet in a very different way, the present invention disclosure is intended to and shall also implicitly include and cover additional corresponding alternative embodiments that are otherwise identical to that explicitly disclosed except that they exclude such prior art structure(s)/step(s), and shall accordingly be deemed as providing sufficient disclosure to support a corresponding negative limitation in a claim claiming such alternative embodiment(s), which exclude such very different prior art structure(s)/step(s) way(s).

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," "some embodiments," "embodiments of the invention," etc., may indicate that the embodiment(s) of the invention so described may include a particular feature, structure, or characteristic, but not every possible embodiment of the invention necessarily includes the particular feature, structure, or characteristic. Further, repeated use of the phrase "in one embodiment," or "in an exemplary embodiment," "an embodiment," do not necessarily refer to the same embodiment, although they may. Moreover, any use of phrases like "embodiments" in connection with "the invention" are never meant to characterize that all embodiments of the invention must include the particular feature, structure, or characteristic, and should instead be understood to mean "at least some embodiments of the invention" includes the stated particular feature, structure, or characteristic.

References to "user", or any similar term, as used herein, may mean a human or non-human user thereof. Moreover, "user", or any similar term, as used herein, unless expressly stipulated otherwise, is contemplated to mean users at any stage of the usage process, to include, without limitation, direct user(s), intermediate user(s), indirect user(s), and end user(s). The meaning of "user", or any similar term, as used herein, should not be otherwise inferred or induced by any pattern(s) of description, embodiments, examples, or referenced prior-art that may (or may not) be provided in the present patent.

References to "end user", or any similar term, as used herein, is generally intended to mean late stage user(s) as opposed to early stage user(s). Hence, it is contemplated that there may be a multiplicity of different types of "end user" near the end stage of the usage process. Where applicable, especially with respect to distribution channels of embodiments of the invention comprising consumed retail products/services thereof (as opposed to sellers/vendors or Original Equipment Manufacturers), examples of an "end user" may include, without limitation, a "consumer", "buyer", "customer", "purchaser", "shopper", "enjoyer", "viewer", or individual person or non-human thing benefiting in any way, directly or indirectly, from use of, or interaction with, some aspect of the present invention.

In some situations, some embodiments of the present invention may provide beneficial usage to more than one stage or type of usage in the foregoing usage process. In such cases where multiple embodiments targeting various stages of the usage process are described, references to "end user", or any similar term, as used therein, are generally intended to not include the user that is the furthest removed, in the foregoing usage process, from the final user therein of an embodiment of the present invention.

Where applicable, especially with respect to retail distribution channels of embodiments of the invention, intermediate user(s) may include, without limitation, any individual person or non-human thing benefiting in any way, directly or indirectly, from use of, or interaction with, some aspect of the present invention with respect to selling, vending, Original Equipment Manufacturing, marketing, merchandising, distributing, service providing, and the like thereof.

References to "person", "individual", "human", "a party", "animal", "creature", or any similar term, as used herein, even if the context or particular embodiment implies living user, maker, or participant, it should be understood that such characterizations are sole by way of example, and not limitation, in that it is contemplated that any such usage, making, or participation by a living entity in connection with making, using, and/or participating, in any way, with embodiments of the present invention may be substituted by such similar performed by a suitably configured non-living entity, to include, without limitation, automated machines, robots, humanoids, computational systems, information processing systems, artificially intelligent systems, and the like. It is further contemplated that those skilled in the art will readily recognize the practical situations where such living makers, users, and/or participants with embodiments of the present invention may be in whole, or in part, replaced with such non-living makers, users, and/or participants with embodiments of the present invention. Likewise, when those skilled in the art identify such practical situations where such living makers, users, and/or participants with embodiments of the present invention may be in whole, or in part, replaced with such non-living makers, it will be readily apparent in light of the teachings of the present invention how to adapt the described embodiments to be suitable for such non-living makers, users, and/or participants with embodiments of the present invention. Thus, the invention is thus to also cover all such modifications, equivalents, and alternatives falling within the spirit and scope of such adaptations and modifications, at least in part, for such non-living entities.

Headings provided herein are for convenience and are not to be taken as limiting the disclosure in any way.

The enumerated listing of items does not imply that any or all of the items are mutually exclusive, unless expressly specified otherwise.

It is understood that the use of specific component, device and/or parameter names are for example only and not meant to imply any limitations on the invention. The invention may thus be implemented with different nomenclature/terminology utilized to describe the mechanisms/units/structures/components/devices/parameters herein, without limitation. Each term utilized herein is to be given its broadest interpretation given the context in which that term is utilized.

Terminology. The following paragraphs provide definitions and/or context for terms found in this disclosure (including the appended claims):

"Comprising." This term is open-ended. As used in the appended claims, this term does not foreclose additional structure or steps. Consider a claim that recites: "A memory controller comprising a system cache . . . " Such a claim does not foreclose the memory controller from including additional components (e.g., a memory channel unit, a switch).

"Configured To." Various units, circuits, or other components may be described or claimed as "configured to" perform a task or tasks. In such contexts, "configured to" or "operable for" is used to connote structure by indicating that the mechanisms/units/circuits/components include structure (e.g., circuitry and/or mechanisms) that performs the task or tasks during operation. As such, the mechanisms/unit/circuit/component can be said to be configured to (or be operable) for perform(ing) the task even when the specified mechanisms/unit/circuit/component is not currently operational (e.g., is not on). The mechanisms/units/circuits/components used with the "configured to" or "operable for" language include hardware—for example, mechanisms, structures, electronics, circuits, memory storing program instructions executable to implement the operation, etc. Reciting that a mechanism/unit/circuit/component is "configured to" or "operable for" perform(ing) one or more tasks is expressly intended not to invoke 35 U.S.C. sctn. 112, sixth paragraph, for that mechanism/unit/circuit/component. "Configured to" may also include adapting a manufacturing process to fabricate devices or components that are adapted to implement or perform one or more tasks.

"Based On." As used herein, this term is used to describe one or more factors that affect a determination. This term does not foreclose additional factors that may affect a determination. That is, a determination may be solely based on those factors or based, at least in part, on those factors. Consider the phrase "determine A based on B." While B may be a factor that affects the determination of A, such a phrase does not foreclose the determination of A from also being based on C. In other instances, A may be determined based solely on B.

The terms "a", "an" and "the" mean "one or more", unless expressly specified otherwise.

Unless otherwise indicated, all numbers expressing conditions, concentrations, dimensions, and so forth used in the specification and claims are to be understood as being modified in all instances by the term "about." Accordingly, unless indicated to the contrary, the numerical parameters set forth in the following specification and attached claims are approximations that may vary depending at least upon a specific analytical technique.

The term "comprising," which is synonymous with "including," "containing," or "characterized by" is inclusive or open-ended and does not exclude additional, unrecited elements or method steps. "Comprising" is a term of art used in claim language which means that the named claim elements are essential, but other claim elements may be added and still form a construct within the scope of the claim.

As used herein, the phase "consisting of" excludes any element, step, or ingredient not specified in the claim. When the phrase "consists of" (or variations thereof) appears in a clause of the body of a claim, rather than immediately following the preamble, it limits only the element set forth in that clause; other elements are not excluded from the claim as a whole. As used herein, the phase "consisting essentially of" and "consisting of" limits the scope of a claim to the specified elements or method steps, plus those that do not materially affect the basis and novel characteristic(s) of the claimed subject matter (see Norian Corp. v Stryker Corp., 363 F.3d 1321, 1331-32, 70 USPQ2d 1508, Fed. Cir. 2004). Moreover, for any claim of the present invention which claims an embodiment "consisting essentially of" or "consisting of" a certain set of elements of any herein described embodiment it shall be understood as obvious by those skilled in the art that the present invention also covers all possible varying scope variants of any described embodiment(s) that are each exclusively (i.e., "consisting essentially of") functional subsets or functional combination thereof such that each of these plurality of exclusive varying scope variants each consists essentially of any functional subset(s) and/or functional combination(s) of any set of elements of any described embodiment(s) to the exclusion of any others not set forth therein. That is, it is contemplated that it will be obvious to those skilled how to create a multiplicity of alternate embodiments of the present invention that simply consisting essentially of a certain functional combination of elements of any described embodiment(s) to the exclusion of any others not set forth therein, and the invention thus covers all such exclusive embodiments as if they were each described herein.

With respect to the terms "comprising," "consisting of," and "consisting essentially of," where one of these three terms is used herein, the presently disclosed and claimed subject matter may include the use of either of the other two terms. Thus in some embodiments not otherwise explicitly recited, any instance of "comprising" may be replaced by "consisting of" or, alternatively, by "consisting essentially of", and thus, for the purposes of claim support and construction for "consisting of" format claims, such replacements operate to create yet other alternative embodiments "consisting essentially of" only the elements recited in the original "comprising" embodiment to the exclusion of all other elements.

Devices or system modules that are in at least general communication with each other need not be in continuous communication with each other, unless expressly specified otherwise. In addition, devices or system modules that are in at least general communication with each other may communicate directly or indirectly through one or more intermediaries.

A description of an embodiment with several components in communication with each other does not imply that all such components are required. On the contrary a variety of optional components are described to illustrate the wide variety of possible embodiments of the present invention.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

An embodiment of the present invention may provide a variable diameter impeller. In some embodiments variable diameter impellers may be implemented as centrifugal pump impellers that may increase in diameter with an increase in pump speed and decrease in diameter with a decrease in pump speed in variable flow pumping systems. It is believed that some embodiments may reduce the electrical consumption of a centrifugal pump connected to an electric motor and, depending on the power source for the motor, may also reduce the use of petroleum products, coal, natural gas, biofuels, etc.

Figure 1B:
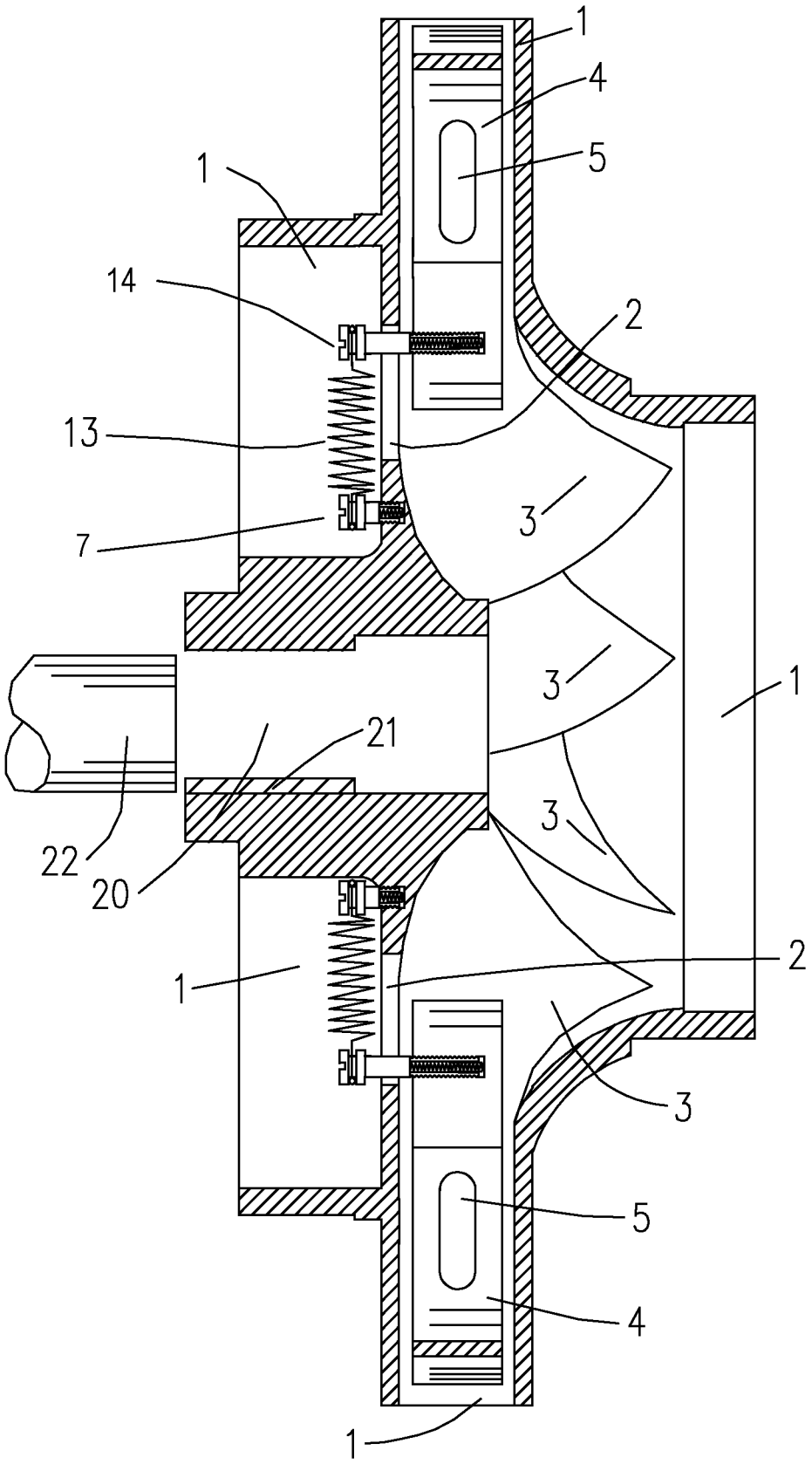
Figure 1C:
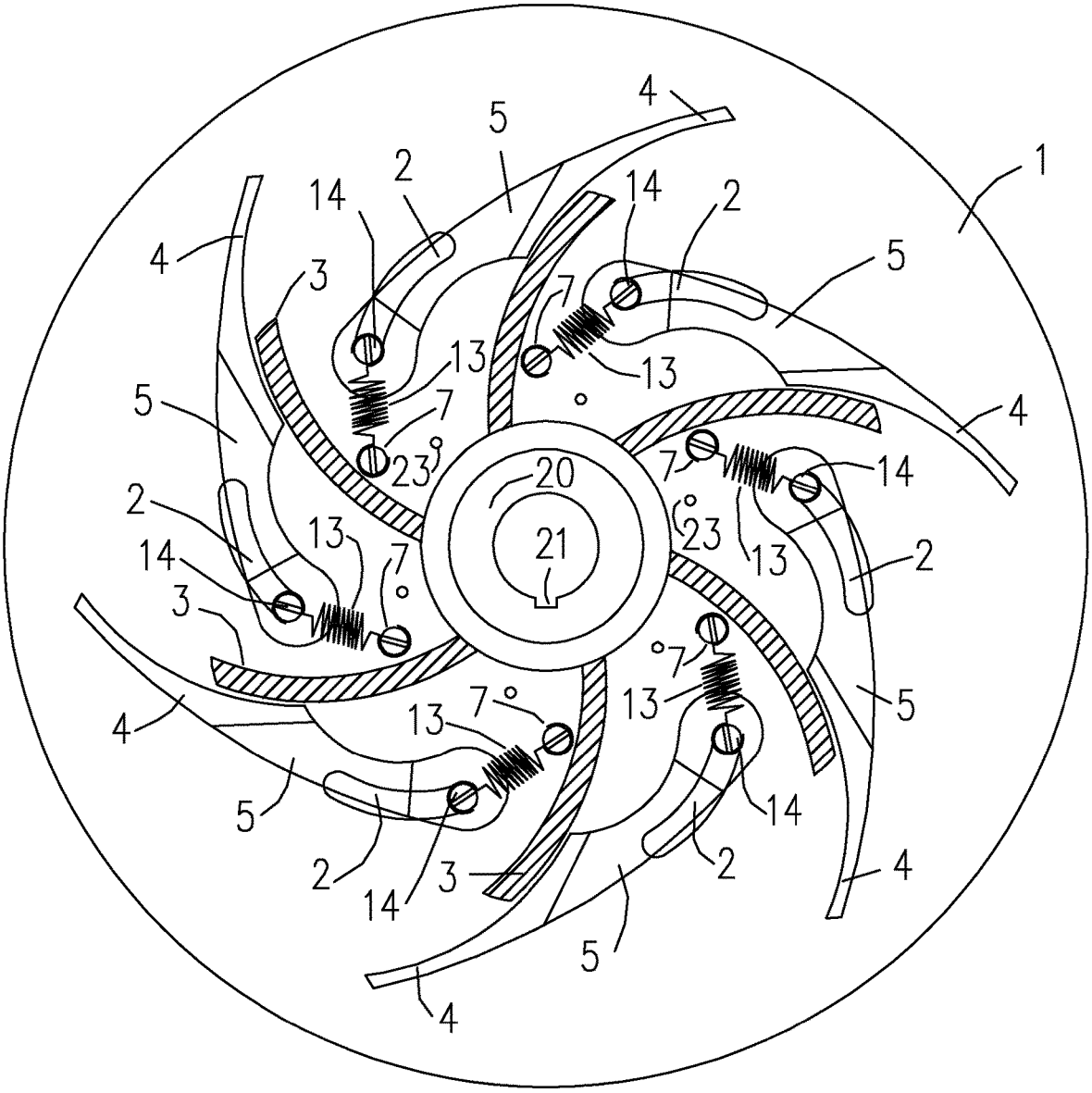
Figure 1D:
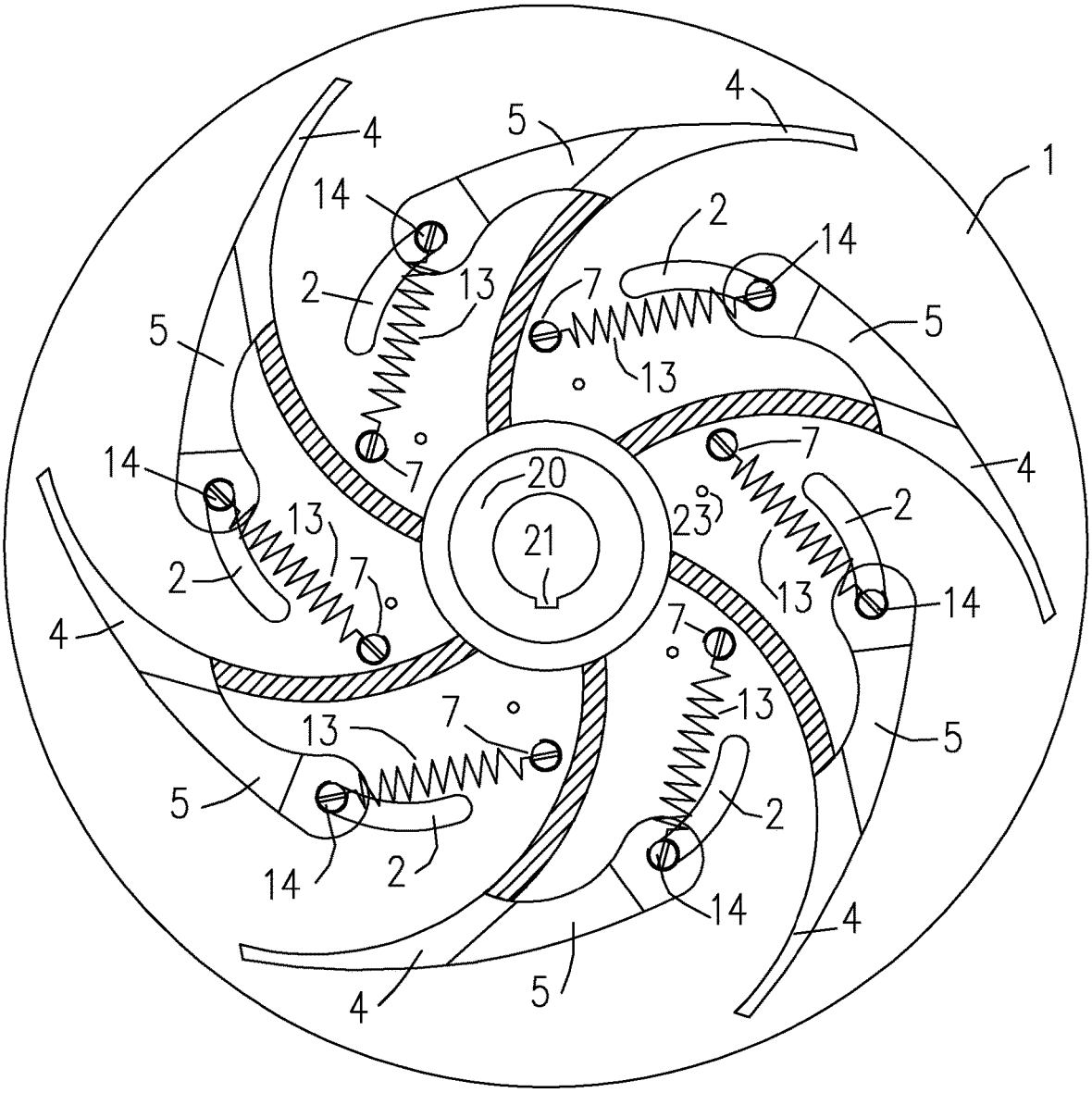
Figure 1E:
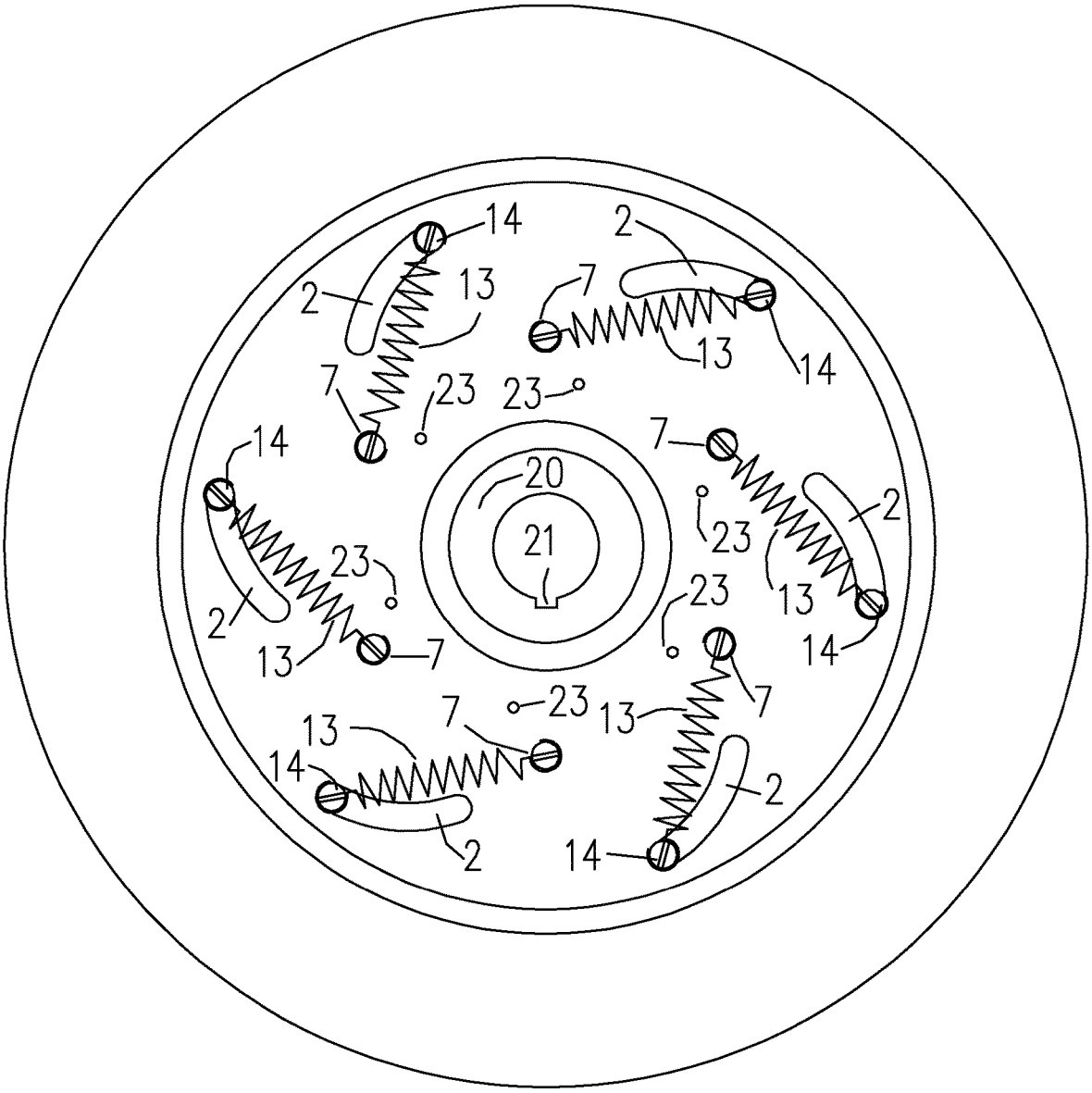

FIG. 1A, FIG. 1B, FIG. 1C, FIG. 1D, and FIG. 1E illustrate an exemplary enclosed, variable diameter impeller for moving fluid or gas, comprising fixed vanes 3 and extendable vanes 4, in accordance with an embodiment of the present invention. FIG. 1A is a cross sectional view of the enclosed impeller with extendable vanes 4 fully retracted. FIG. 1B is a cross sectional view of the enclosed impeller with extendable vanes 4 fully extended. FIG. 1C is a diagrammatic front view of the impeller with extendable impeller vanes 4 in a fully retracted position. FIG. 1D is a diagrammatic front view of the impeller with extendable impeller vanes 4 in a fully extended position, and FIG. 1E is a diagrammatic rear view of the enclosed impeller. In the present embodiment, the centrifugal impeller may be surrounded by an impeller housing 1 that may comprise multiple elongated curved slots 2 and a central hole 20. Multiple fixed impeller vanes 3 may be positioned around central hole 20 of housing 1, and multiple extendable impeller vanes 4 may be engaged with housing 1 at elongated curved slots 2 by a first engagement means 14, In addition, multiple springs 13 in torsion, that typically have no memory of their past positions, may be engaged with housing 1 by a second engagement means 7 and may further engage extendable vanes 4 with housing 1. Springs 13 may be made of a super alloy such as, but not limited to, INCONEL® alloy 740. Springs may be torsion springs made of high grade stainless steel or carbon steel. It is contemplated that various different types of engagement means 7 and 14 may be used including, without limitation, hollow screws, solid screws, hollow or solid bolts, tubes with flanged or flared ends, rivets, or pins. Each individual torsion spring may be replaced with a single, extension type, circular Garter spring that exerts an inward radial force as the circular spring widens when flow increases to extend the vanes. A Garter spring is a coiled steel spring connected at the ends to create a circular shape. The Garter spring can be enclosed inside a rubber seal. A miniature gas spring like the kind that opens and closes automobile trunk lids may also substitute for the torsion spring. The present embodiment is shown by way of example with six sets of fixed vanes 3 and extendable vanes 4. Alternate embodiments may be implemented with more or fewer sets of fixed and extendable vanes. In the present embodiment, extendable vanes 4 may each comprise an opening 5 through which fluid or gas may continually pass while substantially limiting additional restriction on flow. A motor driven shaft 22 may be inserted into central hole 20, and a locking pin (not shown) may be inserted into a keyway 21 in central hole 20 to secure shaft 22 in place. In some alternate embodiments, the enclosed impeller may be secured to the motor driven shaft using a multiplicity of other suitable means such as, but not limited to, screws, bolts, a flanged connector, magnetic coupling, welding, or adhesive. In the present embodiment, multiple impeller bleed holes 23 may be formed in housing 1, which may help equalize fluid pressure on both sides of the impeller.

An implementation of the present embodiment may be applied to large radial flow type centrifugal pumps that employ closed type, cast bronze or cast stainless steel impellers. Those skilled in the art will readily recognize, in light of and in accordance with the teachings of the present invention, that some implementations may be applied to various other types of pumps such as, but not limited to, pumps made of different materials including, without limitation, other metals or plastics, pumps of a multiplicity of suitable sizes, and pumps with impellers formed by machining or other manufacturing methods rather than casting. Moreover, some implementations may be applied to other types of centrifugal equipment including, but not limited to, fans, compressors, and turbines. Another implementation of the present embodiment may be applied to axial flow pumps that use centrifugal type impellers. A variable boat propeller is also possible using the same approach except with a flat blade extendable vane that slides in the slot instead of a cast extendable vane that slides in the slot. Some embodiments may be used to pump fluids or gases in a multiplicity of suitable applications including, but not limited to, heating and cooling systems for large commercial sector buildings, hydroelectric power plants, and various water delivery systems such as, but not limited to swimming pool pumps.

Figure 2A:
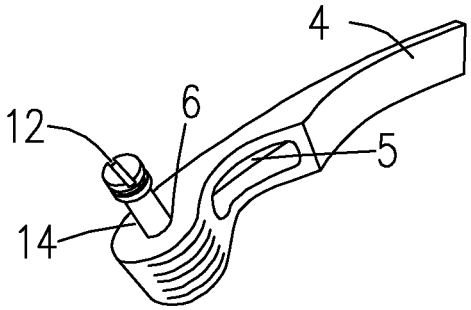
FIG. 2A and FIG. 2B illustrate an exemplary extendable vane for a variable diameter impeller, in accordance with an embodiment of the present invention.
Figure 2B:
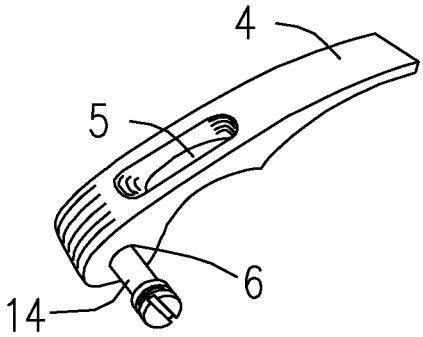

FIG. 2A and FIG. 2B illustrate an exemplary extendable vane 4 for a variable diameter impeller, in accordance with an embodiment of the present invention. FIG. 2A is a perspective bottom view of extendable vane 4, and FIG. 2B is a perspective top view of extendable vane 4. In the present embodiment, extendable vane 4 comprises an elongated opening 5, an engagement hole 6 into which first engagement means 7 may be inserted.

Figure 3A:
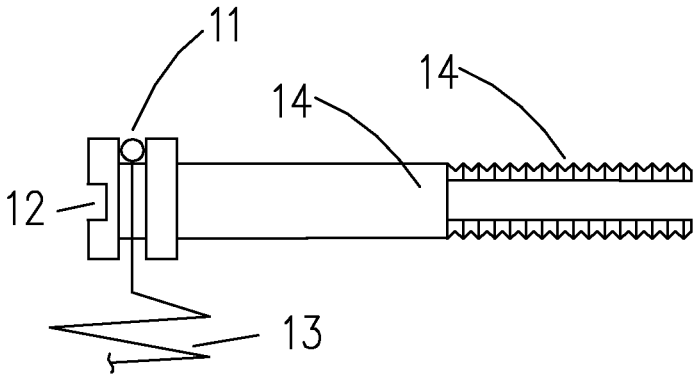
FIG. 3A and FIG. 3B illustrate exemplary engagement means for movably connecting an extendable vane to the housing of an enclosed variable diameter impeller, in accordance with an embodiment of the present invention.
Figure 3B:
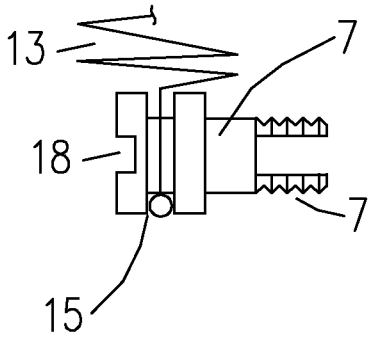

FIG. 3A and FIG. 3B illustrate exemplary engagement means 7 and 14 for movably connecting an extendable vane to the housing of an enclosed variable diameter impeller, in accordance with an embodiment of the present invention. FIG. 3A is a diagrammatic side view of first engagement means 14 for engaging an extendable vane within an elongated curved slot 2 in the housing, and FIG. 3B is a diagrammatic side view of second engagement means 7 for connecting an end of a torsion spring 13 to the housing. In the present embodiment, first engagement means 14 is implemented as a long threaded hollow screw, and second engagement means 7 is implemented as a short threaded hollow screw. As described above some embodiments may employ various different types of engagement means. Hollow screws keep pressure on the screw to keep the screw from getting loose from all the spinning and then damaging the pump. Referring to FIG. 3A, a slotted head 12 of first engagement means 14 may comprise a first groove 11 into which an end of spring 13 may be placed to connect spring 13 to the first engagement means 14. Referring to FIG. 3B, a slotted head 18 of second engagement means 7 may comprise a second groove 15 into which the other end of spring 13 may be placed to connect spring 13 to the second engagement means 7.

Figure 4:
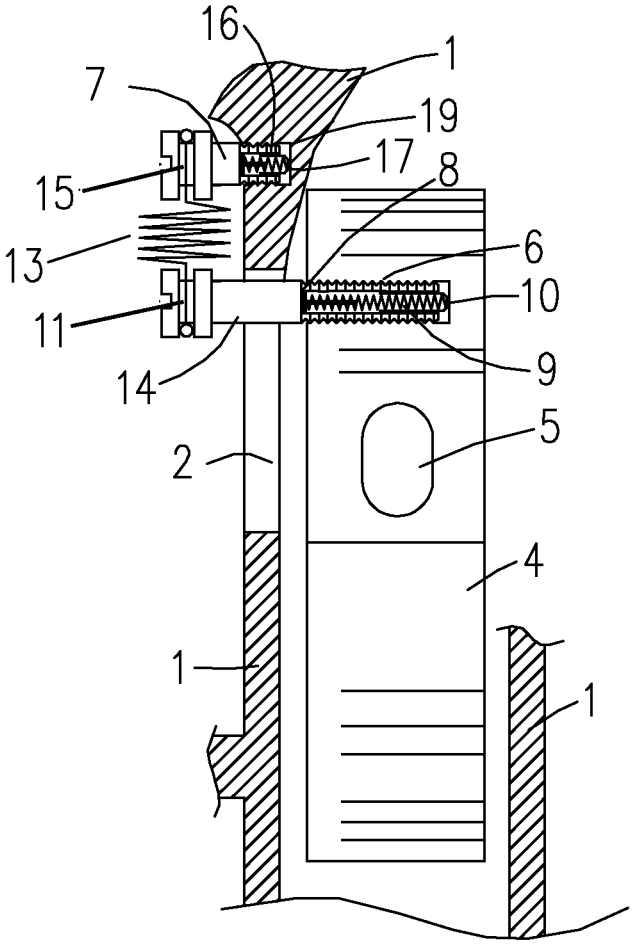
FIG. 4 is a cross sectional view of a portion of an impeller housing with a connected extendable vane in a fully retracted position, in accordance with an embodiment of the present invention.

FIG. 4 is a cross sectional view of a portion of an impeller housing 1 with a connected extendable vane 4 in a fully retracted position, in accordance with an embodiment of the present invention. In the present embodiment, first engagement means 14 may pass through an elongated curved slot 2 in housing 1 and into a first threaded hole 6 in extendable vane 4. Spring caps 8 and 10 at each end of the first threaded hole 6 may help maintain the alignment of the first engagement means 14. A spring 9 may typically apply pressure on the inside of the hollow portion of engagement means 14. Engagement means 7 may screw into a threaded hole 19, in impeller housing 1. A spring cap 17 may help maintain the alignment of engagement means 7, and a spring 16 may typically apply pressure to the inside of the hollow portion of engagement means 7. A torsion spring 13 may be dynamically extended and retracted between engagement means 7 and 14 with one end connected to a groove 11 in engagement means 14 and the other end connected to a groove 15 in engagement means 7. The second end of spring 13 connected to the second engagement means 7 typically remains fixed to housing 1 while the second end of spring 13 connected to the first engagement means 14 extends and retracts, able to move back and forth as engagement means 14 slides along elongated curved slot 2. It is contemplated that the extendable vanes in alternate embodiments may be connected to the housing and springs using a multiplicity of suitable means such as, but not limited to, various different types of screws and bolts, welding, pins, and combinations thereof. In the present embodiment, extendable vane 4 may comprise an opening 5 as described in the foregoing.

In typical use of the present embodiment, extendable vanes 4 move along elongated curved slots 2 that may follow the contours of fixed vanes 3. This typically enables extendable vanes 4 to become extensions of fixed vanes 3 to increase or decrease the diameter of the enclosed impeller. As extendable vanes 4 extend, the diameter may increase, and as extendable vanes 4 retract, the diameter may decrease. As fluid or gas is pumped through the centrifugal pump, the fluid or gas typically flows between fixed vanes 3 and through openings 5 in extendable vanes 4. As flow increases or decreases based on the rotational speed of the variable speed pump motor and centrifugal force is exerted or diminished on fixed vanes 3 and extendable vanes 4, torsion springs 13 may extend or retract to typically enable extendable vanes 4 to slide outwards or inwards in elongated curved slots 2. Normally, pump speeds simultaneously change with the change in the diameter of the impeller. Typically, at high motor speed extendable vanes 4 extend outward to increase flow, and at low motor speeds extendable vanes 4 retract inwards to reduce flow. It is believed that varying the impeller diameter of a centrifugal pump may be a factor in reducing energy usage where loads constantly fluctuate, and the present embodiment may help to reduce the energy consumption of a centrifugal pump by increasing the rotating pump impeller diameter as the speed increases and decreasing the rotating pump impeller diameter as the speed decreases in variable flow pumping systems.

In the present embodiment, extendable vanes 4 may extend and retract to match the pump manufacturer's impeller vane profile and contours. The clearance between impeller housing 1 and the pump casing may be kept constant and to a minimum to substantially inhibit flow slippage and increased turbulence at the tips of extendable vanes 4, as in the case of a trimmed impeller. In addition the tips of extendable vanes 4 may be machined to reduce vane passing frequency vibrations. When in the fully retracted position, extendable vanes 4 may be at the smallest impeller diameter possible to not violate the pump affinity laws. For example, without limitation, in some embodiments, the diameter of fixed vanes 3 may be selected to manage approximately 65% of the maximum design flow while extendable vanes 4 may account for the increase in impeller diameter from 65% to 100%. In alternate embodiments the fixed vanes may be larger or smaller in diameter in order to manage more or less of the maximum design flow.

Figure 5:
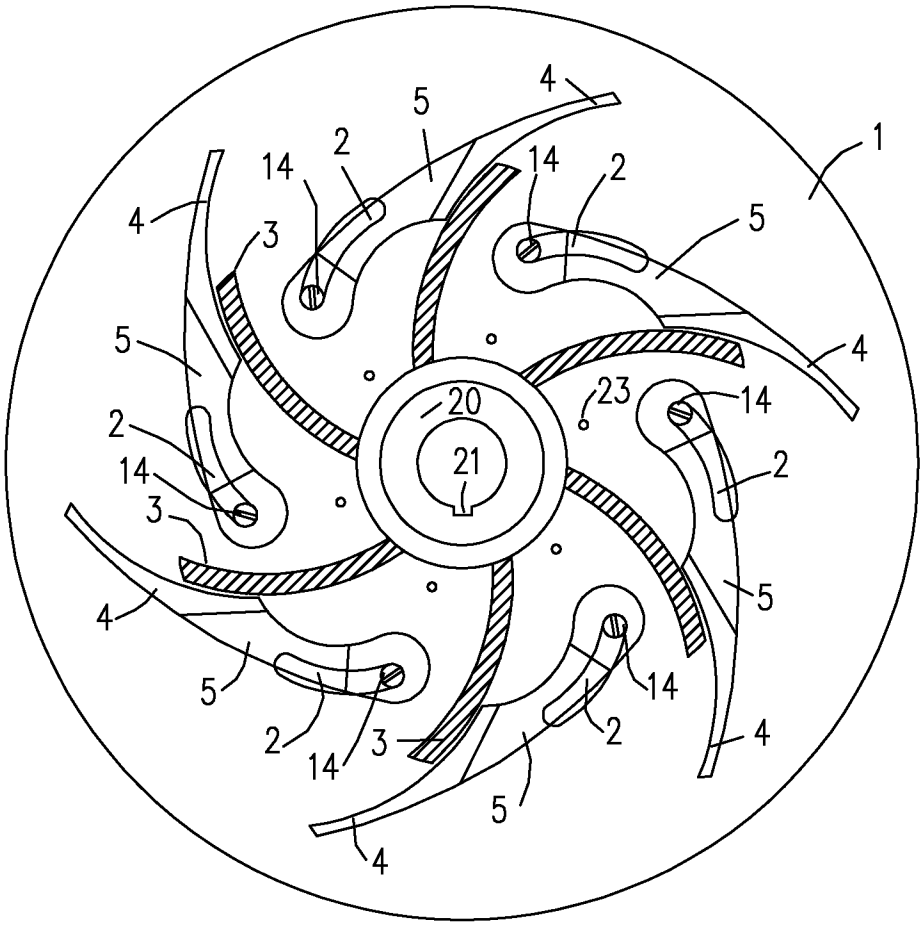
FIG. 5 is a diagrammatic front view of the impeller with the extendable impeller vanes in a fully retracted position using straight springs, in accordance with an embodiment of the present invention.

FIG. 5 is a diagrammatic front view of the impeller with the extendable impeller vanes 4 in a fully retracted position using straight springs, in accordance with an embodiment of the present invention. In this embodiment, the straight springs replaces the circular torsion springs 13.

Figure 6:
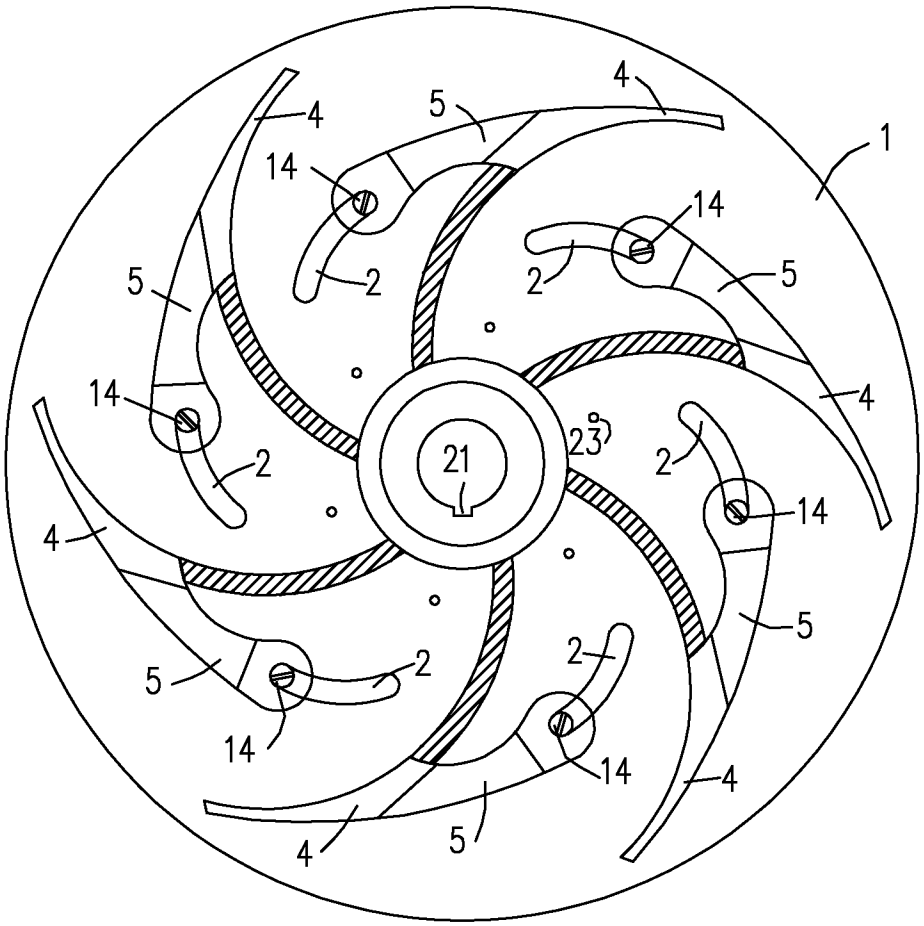
FIG. 6 is a diagrammatic front view of the impeller with the extendable impeller vanes in a fully extended position using straight springs, in accordance with an embodiment of the present invention.

FIG. 6 is a diagrammatic front view of the impeller with the extendable impeller vanes 4 in a fully extended position using straight springs, in accordance with an embodiment of the present invention. In this embodiment, the straight springs replaces the circular torsion springs 13.

Figure 7:
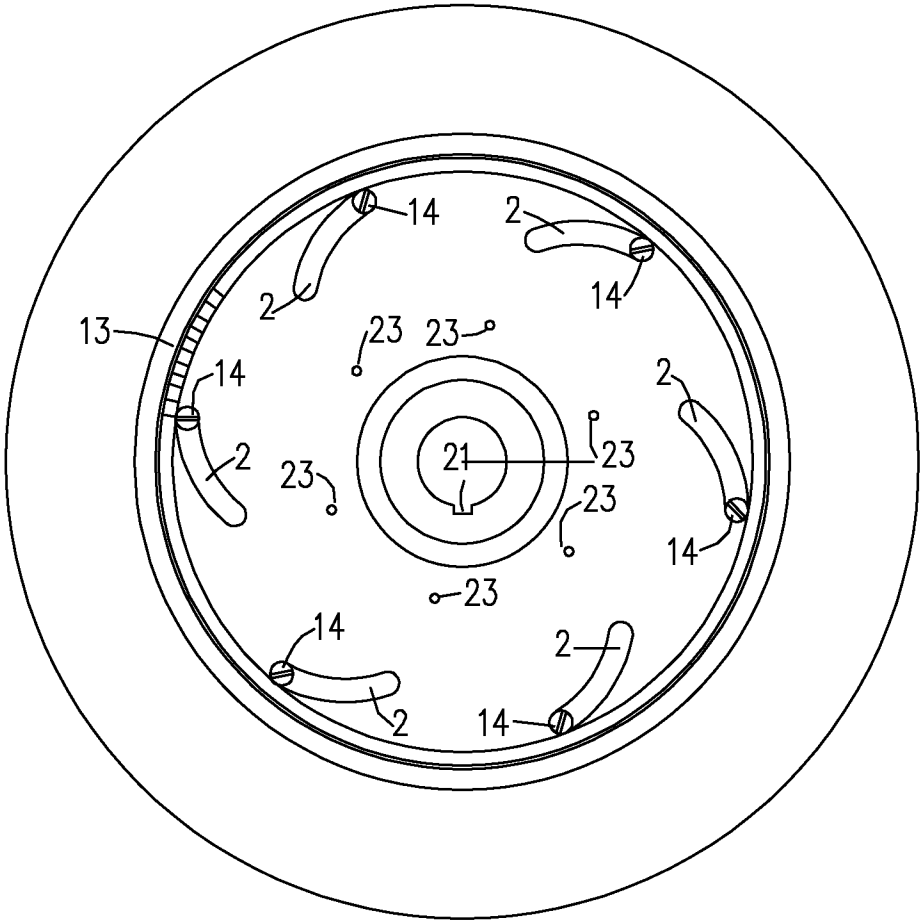
FIG. 7 illustrates an exemplary fully extended circular torsion spring as fluid or gas flow increases, in accordance with an embodiment of the present invention.

FIG. 7 illustrates an exemplary fully extended circular torsion spring 13 as fluid or gas flow increases, in accordance with an embodiment of the present invention. In this embodiment, a single circular torsion spring 13 replaces the multiple circular torsion springs 13 shown in FIGS. 1C-1E. Some of the benefits in the implementation of this embodiment include elimination of the six second engagement means 7 (the short screw) and replacing the six straight springs 13 with the single circular torsion spring 13. This means fewer parts and it may make manufacturing of the device less expensive.

Figure 8:
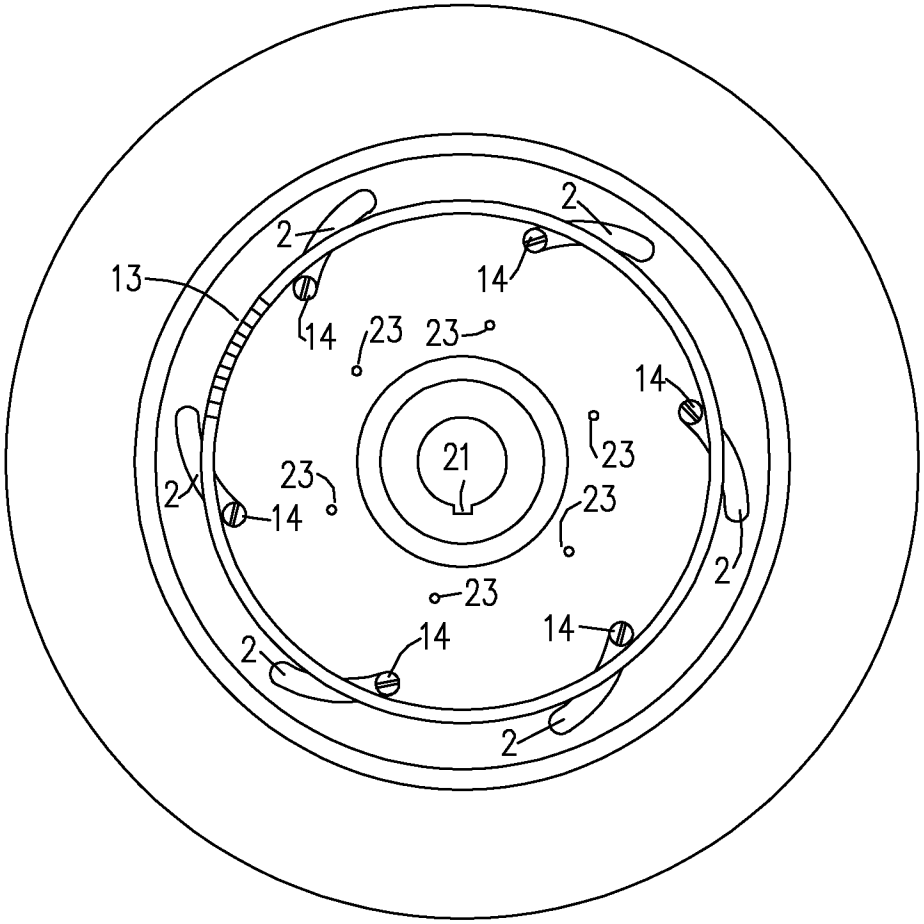
FIG. 8 illustrates an exemplary fully retracted circular torsion spring as fluid or gas flow decreases, in accordance with an embodiment of the present invention.

FIG. 8 illustrates an exemplary fully retracted circular torsion spring 13 as fluid or gas flow decreases, in accordance with an embodiment of the present invention. In this embodiment, a single circular torsion spring 13 replaces the multiple circular torsion springs 13 shown in FIGS. 1C-1E. Some of the benefits in the implementation of this embodiment include elimination of the six second engagement means 7 (the short screw) and replacing the six straight springs 13 with the single circular torsion spring 13. This means fewer parts and it may make manufacturing of the device less expensive.

Figure 9:
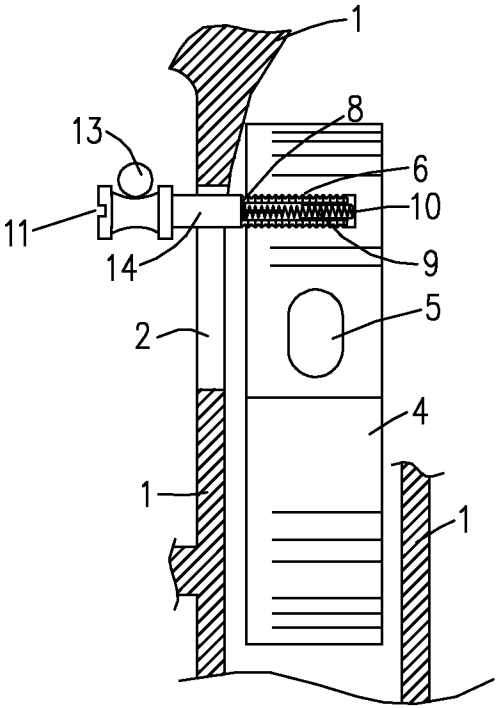
FIG. 9 illustrates a diagrammatic side view of engagement means for connecting circular torsion spring to extendable impeller vanes without a second engagement means, in accordance with an embodiment of the present invention.

FIG. 9 illustrates a diagrammatic side view of first engagement means 14 for connecting a single circular torsion spring to extendable impeller vanes 4 without the second engagement means 7, in accordance with an embodiment of the present invention. Some of the benefits in the implementation of this embodiment include elimination of the six second engagement means 7 (the short screw) which means fewer parts and it may make manufacturing of the device less expensive.

A current approach to providing a variable diameter impeller uses a swinging, vane-type impeller to reduce flow at high engine speeds and maintains maximum flow at low and intermediate engine speeds to suppress engine knocking rather than increasing flow a high speeds and reducing flow at lower speeds. This current approach relates to relatively small vehicle water pumps and may not be able to handle the high stresses experienced by a wider range of flow capacities and operating pressures of radial flow type pumps as used in some embodiments of the present invention. Furthermore, this current approach utilizes the arrangement of a single torsion spring and the action of six plate cams to position the six vane bodies rather than utilizing an arrangement comprising a torsion spring for each movable vane. In the present embodiment, if any of the six torsion springs 13 shown in FIGS. 1C-1E lose their torsion, the pump may still be able to operate with the remaining five torsion springs and the impeller still in acceptable balance and alignment.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Having fully described at least one embodiment of the present invention, other equivalent or alternative methods of implementing a variable diameter impeller according to the present invention will be apparent to those skilled in the art. Various aspects of the invention have been described above by way of illustration, and the specific embodiments disclosed are not intended to limit the invention to the particular forms disclosed. The particular implementation of the variable diameter impeller may vary depending upon the particular context or application. By way of example, and not limitation, the variable diameter impellers described in the foregoing were principally directed to implementations comprising enclosed impellers; however, similar techniques may instead be applied to pumps comprising open impellers, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

The corresponding structures, materials, acts, and equivalents of all means or step plus function elements in the claims below are intended to include any structure, material, or act for performing the function in combination with other claimed elements as specifically claimed.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The Abstract is provided to comply with 37 C.F.R. Section 1.72(b) requiring an abstract that will allow the reader to ascertain the nature and gist of the technical disclosure. That is, the Abstract is provided merely to introduce certain concepts and not to identify any key or essential features of the claimed subject matter. It is submitted with the understanding that it will not be used to limit or interpret the scope or meaning of the claims.

The following claims are hereby incorporated into the detailed description, with each claim standing on its own as a separate embodiment.

What is claimed is:

1. A system comprising:

an impeller device, in which said impeller device comprises a variable diameter impeller of a centrifugal pump, wherein said variable diameter impeller is configured to increase or decrease a flow of fluid from said centrifugal pump;

a housing structure, wherein said housing structure is configured to enclose said centrifugal pump impeller device, and wherein said housing structure is further configured to surround said impeller device and contain said fluid;

an extendable vane arrangement, in which said extendable vane arrangement comprises at least five or more extendable vanes, wherein said extendable vane arrangement is configured to extend outward to increase said fluid flow or retract inwards to reduce said fluid flow;

a fixed vane arrangement, in which said fixed vane arrangement comprises at least five or more fixed vanes equal in number to said at least five or more extendable vanes, wherein said extendable vane arrangement is configured to follow a contour of said fixed vane arrangement, and wherein said fixed vane arrangement is further configured to become an extension of said extendable vane arrangement;

a first engagement means, in which said first engagement means comprises a threaded solid screw or a threaded hollow bolt, wherein said first engagement means is configured to connect said extendable vane arrangement to said housing and engage said extendable vane arrangement within an elongated slot implement;

an opening portion disposed in each of said five or more extendable vanes, wherein said opening portion of each of said five or more extendable vanes is configured to allow fluid pumped through said centrifugal pump, to pass;

an elongated slot implement disposed in said housing structure, in which said elongated slot implement comprises a curved or sloping slot, wherein said elongated curved or sloping slot is configured to engage said first engagement means, and wherein said extendable vane arrangement is configured to move along said elongated curved or sloping slot, said movement along said elongated curved or sloping slot is operable for increasing and decreasing said diameter of said impeller device; and a spring arrangement, in which said spring arrangement is into engagement with said first engagement means and a second engagement means.

2. The system of claim 1, in which said second engagement means comprises a threaded hollow screw, wherein said second engagement means is configured to connect a second end of said spring arrangement to said housing structure.

3. The system of claim 2, further comprising a central hole that is configured to receive a shaft of said centrifugal pump.

4. The system of claim 3, in which said housing structure comprises a plurality of bleed holes, wherein said plurality of bleed holes are configured to be operable for equalizing fluid pressure on both sides of said impeller device.

5. The system of claim 4, wherein said variable diameter impeller device is operable for reducing an energy consumption of said centrifugal pump by increasing said impeller diameter as a speed of said fluid flow increases and decreasing said impeller diameter as the speed of said fluid flow decreases.

6. The system of claim 5, in which said elongated slot implement further comprises multiple curved or sloping slots that are positioned around said central hole portion.

7. The system of claim 4, in which said extendable vane arrangement further comprises an engagement hole portion into which said first engagement means may be inserted.

8. The system of claim 4, in which said spring comprises at least a torsion spring made of high grade stainless steel or carbon steel, or a circular Garter spring that is configured to exert an inward radial force as the circular Garter spring widens when flow increases to extend the vanes.

9. The system of claim 3, in which said centrifugal pump comprises an axial flow pump.

10. The system of claim 9, in which said impeller device further comprises a variable diameter centrifugal impeller.

11. The system of claim 1, in which said housing structure comprises a central hole section that is configured to engage a shaft implement of said centrifugal pump.

12. The system of claim 11, in which said housing structure further comprising a keyway portion that is configured to secure said motor driven shaft in said central hole portion.

13. The system of claim 12, further comprising a locking pin, wherein said locking pin is configured to lock said motor driven shaft in said central hole portion.

14. The system of claim 1, in which said spring comprises a super alloy.

15. A system comprising:

an impeller device, in which said impeller device comprises an impeller of a centrifugal pump, wherein a diameter of said impeller is configured to increase or decrease based on a flow speed of a fluid from said centrifugal pump;

a housing structure, wherein said housing structure is configured to enclose said impeller device;

a fixed vane arrangement, wherein said fixed vane arrangement comprises a contoured vane;

an extendable vane arrangement, wherein said extendable vane arrangement is configured to follow a predetermined contour, and wherein said fixed vane arrangement is configured to become an extension of said extendable vane arrangement, said extension being operable for increasing said diameter of said impeller device;

an opening portion disposed in a center section of said extendable vane arrangement, wherein said opening portion is configured to allow fluid pumped by said centrifugal pump, to pass;

a first engagement means, in which said first engagement means comprises a threaded solid screw or a threaded hollow or solid bolt, wherein said first engagement means is configured to connect said extendable vane arrangement to said housing structure;

an elongated slot implement disposed in said housing structure, in which said elongated slot implement comprises a curved or sloping slot, wherein said elongated curved or sloping slot is configured to engage said first engagement means, and wherein said extendable vane arrangement is configured to move along said elongated curved or sloping slot, said movement along said elongated curved or sloping slot is operable for increasing and decreasing said diameter of said impeller;

a second engagement means, in which said second engagement means comprises a threaded hollow screw, wherein said second engagement means is configured to connect a second end of a spring to said housing structure; and and said spring is into engagement with said first and second engagement means to dynamically increase or decrease said diameter of said impeller.

16. The system of claim 15, further comprising:

a central hole portion in said housing structure that is configured to engage a shaft of said centrifugal pump; and a plurality of bleed holes disposed around said central hole portion, wherein said plurality of bleed holes are operable for equalizing fluid pressure on said impeller device.

17. The system of claim 16, wherein said impeller device is further configured to be operable for reducing an energy consumption of said centrifugal pump by increasing said impeller diameter as a speed of said centrifugal pump increases and decreasing said impeller diameter as the speed decreases.

* * * * *